United States Patent [19]

Mann

[11] Patent Number: 4,958,951

[45] **Date of Patent: * Sep. 25, 1990**

[54] HOT WAX HAIR REMOVER APPARATUS

[75] Inventor: Samuel J. Mann, Englewood, N.J.

[73] Assignee: Inverness Corporation, Fairlawn, N.J.

[ * ] Notice: The portion of the term of this patent subsequent to Sep. 27, 2006 has been disclaimed.

[21] Appl. No.: 225,105

[22] Filed: Jul. 26, 1988

Related U.S. Application Data

[63] Continuation of Ser. No. 716,289, Mar. 26, 1985, Pat. No. 4,773,784, which is a continuation-in-part of Ser. No. 344,135, Jan. 29, 1982, abandoned.

[51] Int. Cl.[5] ..... A45D 40/00; A45D 40/26; A45D 34/04

[52] U.S. Cl. ..... 401/1; 401/5; 401/208; 401/220

[58] Field of Search ..... 401/1, 208, 2, 219, 401/220, 5

[56] References Cited

U.S. PATENT DOCUMENTS

| | | | |
|---|---|---|---|
| 538,297 | 4/1895 | Terry | 401/208 |
| 2,029,056 | 1/1936 | Carlson | 401/208 |
| 2,229,707 | 1/1941 | Testi | 401/219 |
| 2,285,105 | 6/1942 | Bacher | 128/24.3 X |
| 2,892,202 | 6/1959 | Williams | 401/208 |
| 3,048,880 | 8/1962 | Slomon | 401/220 |
| 3,083,397 | 4/1963 | Thomas | 401/220 |
| 3,100,908 | 8/1963 | Engle | 401/220 |
| 3,103,689 | 9/1963 | Borisof | 401/2 |
| 3,235,900 | 2/1966 | Klassen | 401/175 |
| 3,263,265 | 8/1966 | Judson | 401/208 |
| 3,284,839 | 11/1966 | Cook | 401/183 |
| 3,430,816 | 3/1969 | Nadherny et al. | 222/146 HE |
| 3,432,641 | 3/1969 | Welke | 219/433 |
| 3,752,155 | 8/1973 | Blinoff Jr. et al. | 401/1 X |
| 3,858,985 | 1/1975 | Flueash | 401/2 |
| 3,896,973 | 7/1975 | Morgan | 219/433 XL |
| 3,902,043 | 8/1975 | Rogan | 219/433 X |
| 3,981,304 | 9/1976 | Szpur | 401/133 X |
| 4,128,350 | 12/1978 | Gamache | 401/208 |
| 4,147,924 | 4/1979 | Dewitt, Jr. | 219/432 X |
| 4,150,904 | 4/1979 | Stewart | 401/219 |
| 4,773,784 | 9/1988 | Mann | 401/1 |

FOREIGN PATENT DOCUMENTS

| | | | |
|---|---|---|---|
| 895608 | 1/1983 | Belgium . | |
| 2467786 | 5/1981 | France | 604/310 |
| 516924 | 6/1983 | Spain . | |
| 452811 | 5/1968 | Switzerland | 401/208 |

*Primary Examiner*—Steven A. Bratlie
*Attorney, Agent, or Firm*—Blum Kaplan

[57] ABSTRACT

A system for heating and applying a depilatory wax to skin for removal of hair. The system includes a reservoir which stores a supply of the wax and a dispenser coupled to the reservoir. The depilatory wax is essentially solid at room temperature but becomes flowable when heated. The heated wax flows from the reservoir to the dispenser for application. The roller applies the wax in a thin layer to prevent pain and burning.

6 Claims, 4 Drawing Sheets

HOT WAX HAIR REMOVER APPARATUS

CROSS-REFERENCE TO RELATED APPLICATIONS

This is a continuation of application Ser. No. 716,289, filed Mar. 26, 1985, now U.S. Pat. No. 4,773,784, which is a continuation-in-part of Ser. No. 344,135, filed Jan. 29, 1982, now abandoned.

BACKGROUND OF THE INVENTION

The present invention is directed to an apparatus for removing hair by application of a hot wax to the skin, and, in particular, to an applicator system which stores and safely and painlessly applies a hot depilatory wax to the skin in sufficiently thin layers to maximize the effectiveness of epilation. The applicator system includes a heating mechanism to heat wax that is normally stored in a hardened state in an applicator in order to melt the wax for safe application by the applicator to the skin.

Epilation by application of a hot depilatory wax to the skin and removal of the wax from the skin after cooling is an accepted technique for effective, long-lasting hair removal. As the melted wax applied to the skin begins to harden a cloth is pressed thereagainst. After the wax hardens, the cloth is pulled back and pulls the wax and hair captured thereby from a human's pores.

The accepted commercial technique of removing hair by application of a hot wax depilatory usually includes heating a large quantity of depilatory wax to a molten state in a large, open vat. The individual then tests the temperature of the wax by touching. Generally, a skilled individual will apply the melted wax by dipping a spoon or stick applicator into the vat and collecting a blob of molten wax on the applicator and coating the skin in the area where hair is to be removed. Wax is wasted due to the dripping and spilling as the applicator is removed from the vat. Moreover, when the wax is heated to a molten state for application to the skin, it retains a high viscosity similar to that of molasses or thick honey due to the properties thereof. Because of this high viscosity property, the depilatory wax tends to be applied to the skin in thick blobs.

It is noted, however, that depilatory wax is like candle wax and, thus, when molten, can cause severe pain and burning of the skin if applied in thick blobs. Moreover, the imprecise application of molten wax using a spoon or a stick does not permit the thickness of the layer of wax applied to be controlled to any great degree and, the thicker the wax layer applied, the less hair is removed by peeling of the wax from the skin after hardening.

It is for these reasons that heretofore, efficient, safe and burn-free waxing has been largely limited to the skill of trained, experienced salon personnel and have not generally been available for home use due to the severe burning and pain which can occur if the wax is improperly applied. Accordingly, a hot wax hair remover apparatus which permits the depilatory wax to be stored in an applicator, melted within a self-contained reservoir in the applicator, and in which melted wax is applied in a sufficiently thin layer, is desired.

SUMMARY OF THE INVENTION

Generally speaking, in accordance with the instant invention, a hot wax hair remover apparatus includes an applicator having a reservoir for storing a supply of the depilatory wax that is essentially hard at room temperature but becomes viscous when heated to a sufficient temperature. A film dispenser having a roller is supported on the reservoir in fluid communication therewith so that the wax when heated to a low viscous state can flow through the dispenser for application by the roller for epilation. The dispenser is adapted to apply the hot melted wax to the skin in a sufficiently thin layer, preferably between 0.1 and 0.3 mm in thickness, so that the final skin temperature immediately after the wax is applied, is maintained below 111.2° F., the threshold temperature for thermally evoked pain.

In an exemplary embodiment the dispenser is a continuously smooth cylindrical roller formed about the periphery thereof in registration with the axial orientation of the roller. The width of the roller is determined by the precise anatomy to be epillated. The roller and wall surrounding the roller are constructed and arranged to facilitate heating of the wax within the reservoir and use of the roller in a single direction to improve the application of hot wax in thin layers. The thin layer of wax causes adhesion and shearing of the hair to be concentrated at the skin-wax interface rather than interstitially in the thicker wax layer applied under known techniques.

Accordingly, it is an object of the present invention to provide an improved hot wax hair remover apparatus.

A further object of the invention is to provide a hot wax hair remover apparatus which is safe for personal, home and professional use.

Still a further object of the invention is to provide a hot wax applicator device which applies a sufficiently thin layer of hot melted depilatory wax to the skin to prevent burning and pain.

Yet another object of the invention is to provide a hot wax hair remover apparatus which is capable of heating the wax within the applicator and considerably eliminates the risk of burning the skin and evoking of pain to the areas of the skin receiving the hot wax.

Still another object of the instant invention is to provide an improved hot wax epilation device which substantially increases the effectiveness and completeness of hair removal.

Still other objects and advantages of the invention will in part be obvious and will in part be apparent from the specification.

The invention accordingly comprises the features of construction, combination of elements, and arrangement of parts which will be expemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2, 3, 7, 8, 9:
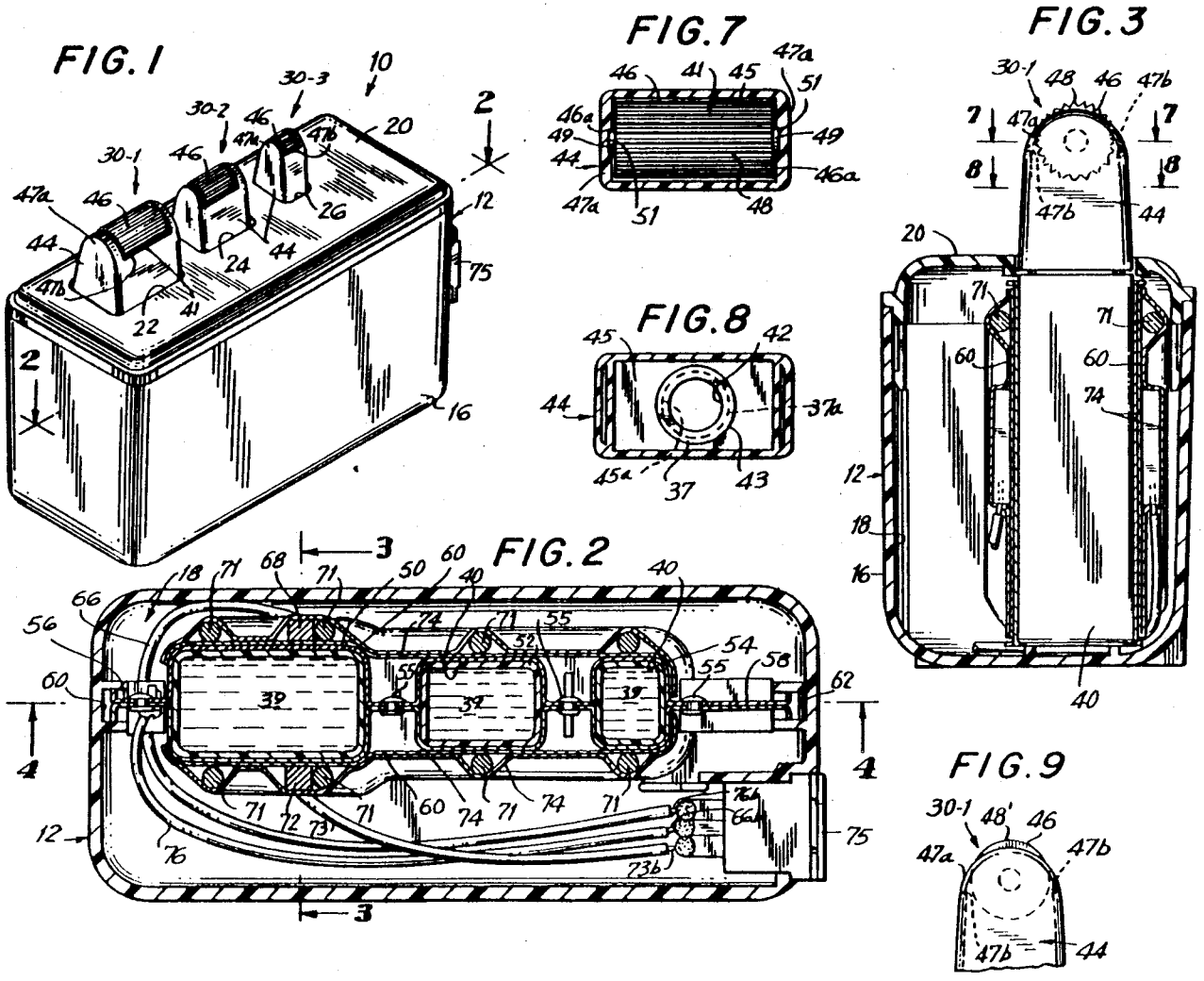
FIG. 1 is a perspective view of a hot wax hair remover apparatus constructed in accordance with a preferred embodiment of the present invention.
FIG. 2 is an enlarged sectional view taken along line 2—2 of FIG. 1.
FIG. 3 is a sectional view taken along line 3—3 of FIG. 2.
FIG. 7 is a sectional view taken along line 7—7 of FIG. 3.
FIG. 8 is a sectional view taken along line 8—8 of FIG. 3.
FIG. 9 is a perspective view of a hot wax applicator having an improved dispensing head constructed in accordance with a preferred embodiment of the instant invention.
Figure 4:
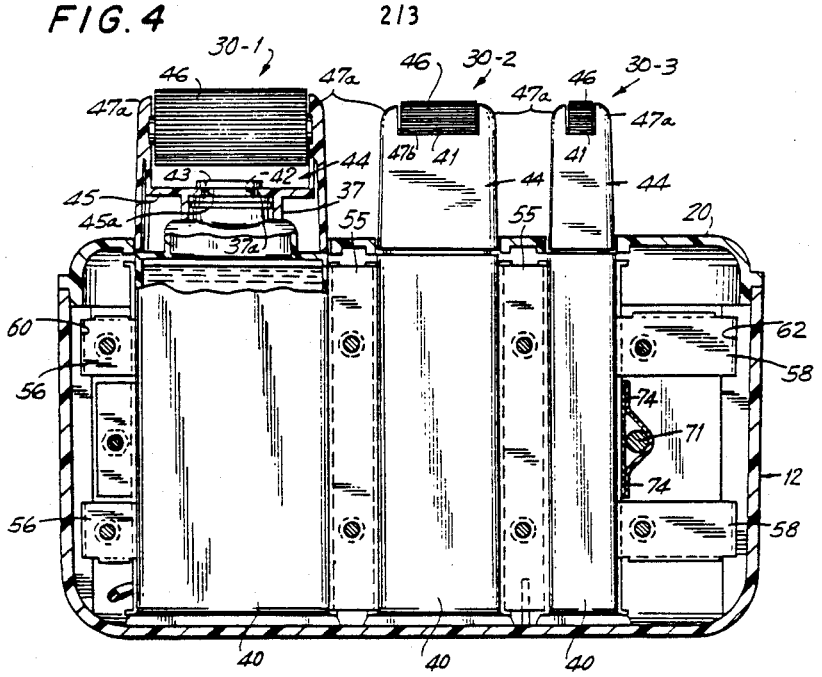
FIG. 4 is a sectional view taken along line 4—4 of FIG. 2.

Reference is first made to FIGS. 1 through 4 wherein a hot wax hair remover system, generally indicated as 10, includes a housing 12 having a unitary bottom and side wall 16 defining an inner chamber generally indicated as 18 and a top wall 20 secured to the bottom and side wall 16. Different sized openings 22, 24 and 26 are provided in top wall 20. Applicator devices 30-1, 30-2 and 30-3 are formed in three different sizes for reasons discussed below and are removably positioned within the chamber 18 and respectively extend through openings 22, 24 and 26. It is noted that the present invention is not limited to requiring three applicator devices and is illustrated with three applicators by way of example only.

Each of the three applicators 30-1, 30-2 and 30-3 are similarly constructed and include a reservoir 40 which is adapted to hold a supply of depilatory wax 39 therein and a dispensing head 44. As particularly shown in FIGS. 4 and 8, reservoir 40 includes a neck finish 37 having an opening 42 at the top 43 thereof through which the depilatory wax can flow when melted in the manner described below.

Dispenser head 44 is hollow and includes an interior cross-strut 45 that defines an opening 45a which is snap fit in an annular recess 37*a* found in neck finish 37 to thereby removably secure the hollow interior of the dispenser head in fluid communication through opening 42 to the reservoir 40. Dispensing head 44 is defined by a rounded upright opposed shoulder 47*a* and a flat wiper wall 47*b* which define an opening 41 for receiving a grooved roller 46 therein. As depicted in FIG. 3, roller 46 includes projections 49 on the ends 46*a* which are captured in blind holes 51 formed on opposed inner surfaces of shoulders 47*a*. Roller 46 is cylindrical and includes a plurality of axially oriented grooves 48 peripherally disposed around the surface thereof. The flat wiper walls 47*b* are spaced from the outer radial dimensions of grooves 48 a predetermined distance to define a clearance of between 0.010 and 0.020 inches to act as a wiper to limit the thickness of the wax flowing onto the roller.

In an exemplary embodiment the reservoir 40 is constructed from a semi-transparent PVC material which allows viewing into the reservoir to determine the amount of depilatory wax therein. Generally, in the art, two types of wax for depilatory purposes are used for hair removal, a hot wax or a cold wax. Cold wax is gummy at room temperature, whereas hot wax is hard to medium hard at room temperature. The depilatory wax of the present invention is a medium hard hot wax made from hydrogenated rosinates and beeswax having a density on the order of 1.080kg/L. This wax is essentially solid and non-flowable at room temperature. In an exemplary embodiment, a wax having 47% triethylene glycol hydrogenated rosinate, 46% glyceryl hydrogenated rosinate and 7% beeswax will provide a wax having the characteristics described herein although these values are by way of example only. When heated to a sufficient temperature of about 150° F. this wax becomes free flowing and, yet, remains hard at room temperature.

Heating sleeves 50, 52 and 54 are constructed of a heattransmissive metal and are provided in housing 12 in alignment with openings 22, 24 and 26 in top wall 20. Heating sleeves 50, 52 and 54 are coupled together by coupling plates 55 to define a unitary structure and are sized to snugly receive applicators 30-1, 30-2 and 30-3 therein. Legs 56 and 58 extend from the ends of the unitary structure defined by coupled sleeves 50, 52 and 54 and are received in slots 60 and 62, defined by the side wall 16. The slots 60 and 62 properly orient the heating sleeves in alignment with the respective openings in top wall 20.

Figure 5:
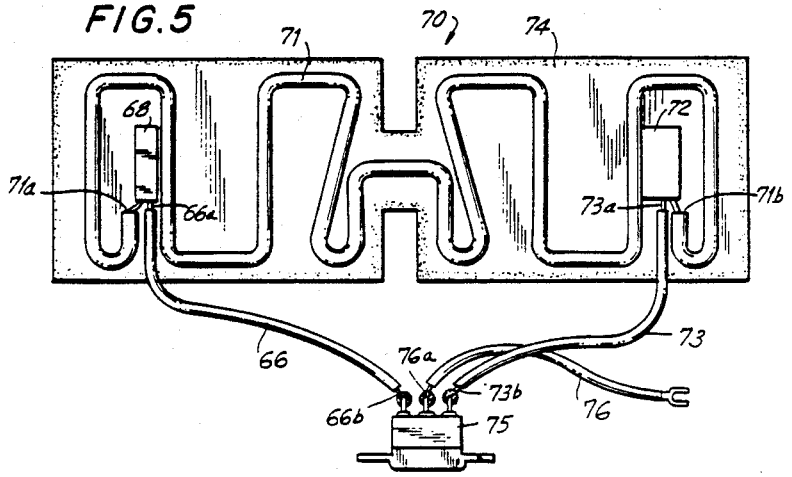
FIG. 5 is an elevational view of the heating mechanism utilized in the hot wax apparatus depicted in FIGS. 1 through 4, shown removed and spread flat.

A heating assembly 70 is depicted in FIG. 5, and is wrapped around heating sleeves 50, 52 and 54. Heating blanket 70 includes a rope heater 71 sandwiched between thin pressure sensitive aluminum sheets 74. Rope heater 71 is spread between aluminum sheets 74 so as to provide at least one portion thereof along opposite sides of heating sleeves 50, 52 and 54. The rope heater 71 is disposed on both sides of the heating sleeves.

A first terminal wire 66 includes a first end 66a coupled to a first end 71*a* of rope heater 71 through a thermostate 68. A second terminal wire 73 includes a first end 73*a* coupled to the second end 71*b* of rope heater 71 through a fuse 72. The second ends 66*b* and 73*b* of terminal wires 66 and 73 are coupled to a socket 75. One end 76*a* of a ground wire 76 is also coupled to socket 75. The second end 77*b* of ground wire 76 is coupled to a leg 56 for grounding. Socket 75 is adapted to be coupled to a suitable power source such as to receive an AC line cord which applies a voltage across ends 71*a* and 71*b* of rope heater 71 for heating rope heater 71. The heat created by rope heater 71 is passed through aluminum sheets 74 to heat sleeves 50, 52 and 54.

In operation, applicators 30-1, 30-2 and 30-3 are placed into heating sleeves 50, 52 and 54 through the respective openings in the top wall 20. The rope heater 71 is activated to surround the heating sleeves 50, 52 and 54 with heat. Thermostat 68 controls the heating and limits the temperature to 105° F. The heat from heating sleeves 50, 52 and 54 will, in turn, be transferred to each of the reservoirs 40 and, thus, to the depilatory wax 39 stored within each reservoir. By heating the wax to a suitable temperature the wax becomes flowable. In the present invention, the depilatory wax is heated to a preferred temperature of 150° F. which assumes that the depilatory wax is melted to a sufficient degree for application by applicator device 30 in the manner described below. Thus, the instant invention is characterized by the heating of the depilatory wax above an individual's threshold temperature of thermally evoked pain.

Each applicator is variously sized for application of the hot melted depilatory wax various to various surfaces of the human body. For example, applicator 30-1 is for application of wax to a person's legs for hair removal. Applicator 30-2 is for proper application of the hot depilatory wax to skin at an underarm area. Applicator device 30-3 is for proper application of the hot depilatory wax 39 to the eyebrow area of the face for hair removal therefrom.

Figure 6:
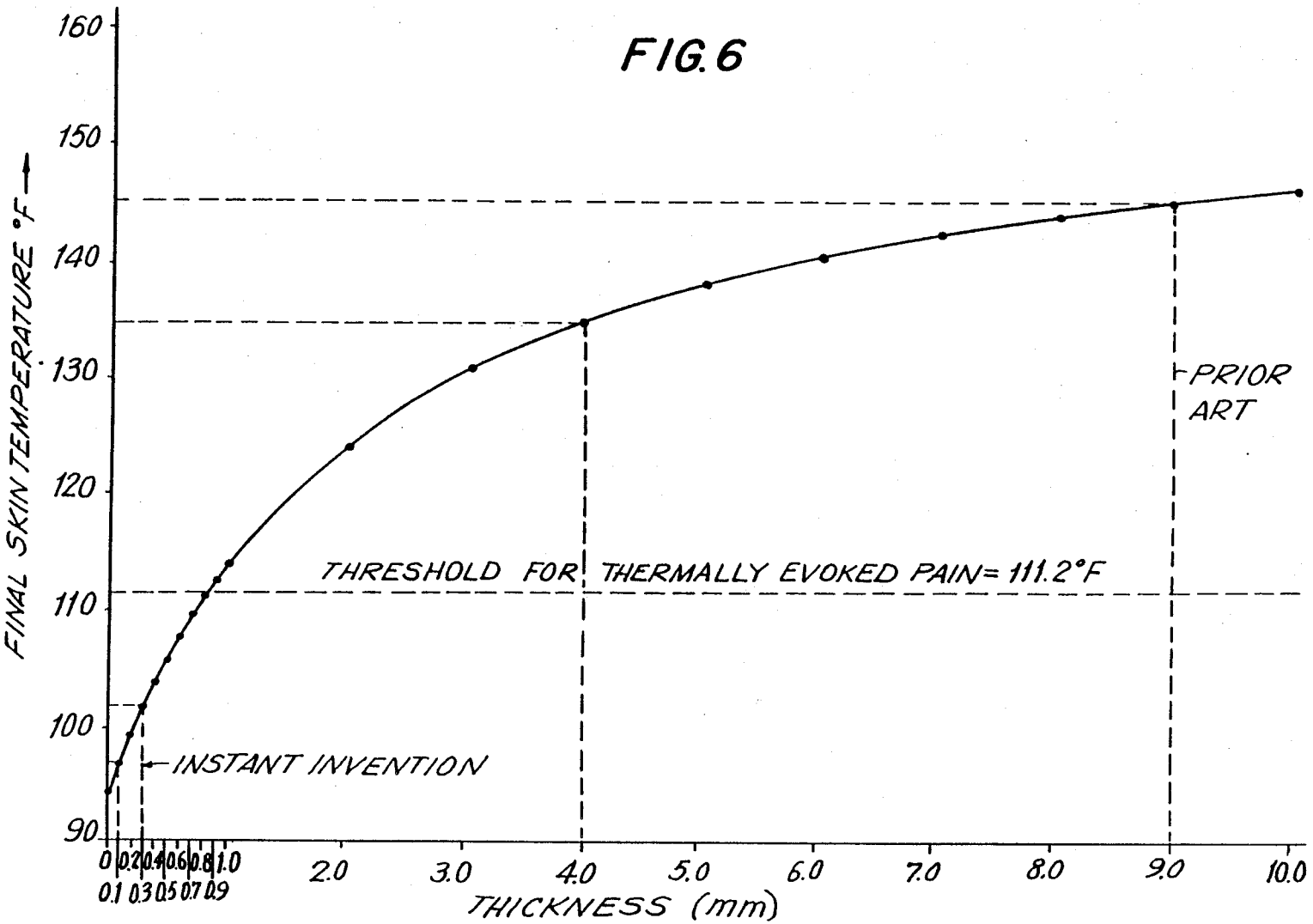
FIG. 6 is a graph illustrating final skin temperature verses thickness of wax applied for describing the characteristics of the hot wax hair remover apparatus of the present invention.
Figure 9:
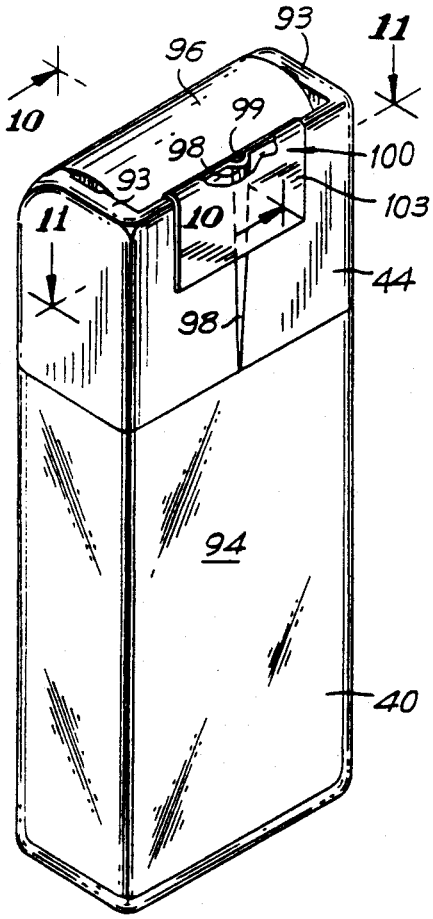

Referring to the graph depicted in FIG. 6, the various parameters under which the melted wax is applied to the skin by applicator device 30, in accordance with the present invention, is described. An individual's threshold temperature for thermally evoked pain caused by application of heat to the kin is 111.2° F. Nevertheless, in the instant invention, the depilatory wax in reservoir 40 is heated to about 150° F. Application of wax heated to 150° F. by means of a stick or spoon would normally cause pain and if applied in a thick enough layer to raise the final skin temperature above 111.2° F. can burn the individual's skin. The critical value is the final skin temperature $\tau_{SF}$ immediately after the hot wax is applied.

The final skin temperature $\tau_{SF}$ can be represented by the following equation:

TABLE 1

| Layer formed Conditions | Layer formed: First Layer (Charge injection inhibition layer) | Second Layer (Photo-conductive layer) | Third Layer (Surface protective layer) |
|---|---|---|---|
| Gas used & Flow rate | | | |
| $SiH_4$ gas | 200 SCCM | 200 SCCM | 10 SCCM |
| $B_2H_6$ gas | 200 ppm (against $SiH_4$) | — | — |
| $CH_4$ gas | — | — | 200 SCCM |
| Substrate Temperature(°C.) | | 250 ± 5 | |
| Inner Pressure (Torr) | | 0.5 | |
| Discharging Frequency (MHz) | | 13.56 | |
| Discharging Power(W/cm$^2$) | | 0.18 | |
| Gas Flow Speed (m/s) | | 200 | |
| Layer Thickness (μm) | 2.0 | 20.0 | 0.5 |

Where:

$\rho_W$=wax density=1.080 kg/L $V_W$=wax volume−volume/cm$^2$ $\overline{C}_W$=specific heat of wax - 0.434 (@150° F.)

$\tau_W$=wax temperature=150° F.=(343.2° K)

$\rho_S$=skin density=1.071 kg/L $V_S$=skin volume=$1.0\times10^{-7}$ m$^3$ $\overline{C}_S$=specific heat of skin=1.000

$\tau_{SI}$=initial skin temperature=90° F.=(307.7° K).

Thus, as aforenoted, the applicator of the present invention is constructed to apply a sufficiently thin layer of hot melted wax to the skin such that the threshold temperature for thermally evoked pain is never reached on the skin surface. Referring to FIG. 6, when the thickness of wax applied is below 0.8 mm and the wax is heated to a temperature of about 150° F., the temperature threshold for thermally evoked pain, namely, 111.2° F., will not be reached on the skin's surface. Accordingly, the clearance between the roller and the wiper wall **47*b*** is specifically selected so as to apply a layer of hot wax to the skin having a thickness no greater than 0.8 mm. In a preferred embodiment, the thickness of the layer of wax applied is between 0.1 mm and 0.3 mm. In this range, the final skin temperature will be between 97° F. and 102° F., which is well below an individual's threshold temperature for thermally evoked pain although the wax has been heated to a temperature of about 150° F. to permit the wax to become flowable and dispensed by the dispenser.

When an applicator is turned so that roller 46 is directed downwardly, gravity will cause the hot melted wax to flow through opening 42 in the reservoir to surround roller 46 on the inside of the cap. Roller 46 is then pressed against the skin and rolled thereagainst. The hot melted wax supplied to roller 46 is then dispensed through the clearance between wiper wall 47b and roller 46 and is applied by roller 46 as a thin layer of wax. The grooves 48 on roller 46 supply the necessary friction to the roller to overcome the viscosity of the melted wax so that roller 46 can be rolled against the skin to apply a thin layer of melted wax. As best depicted in FIG. 7, the clearance 41 in the dispenser head is preferably between 0.01 and 0.02 inches, so as to provide the reduced layer thickness.

Roller 46 applies a thin layer of wax to the skin as it is rolled thereon. As aforenoted, the thickness of the wax layer applied is no greater than 0.8 mm and preferably between 0.1 mm and 0.3 mm. Although the wax is heated to temperatures as high as 150° F., the final skin temperature immediately after the hot wax is applied is maintained below 111.2° F., the temperature threshold for thermally evoked pain. Immediately after the wax is applied to the skin, a fabric, such as polyester cloth, is pressed thereagainst. Alternatively, the wax can be applied to a cloth and the cloth immediately pressed against the skin. After the wax cools and hardens to the cloth the wax is peeled off of the skin thereby removing the hair. Due to the thinness of the wax layer, the wax is sheared at the wax-skin interface thereby leaving the skin smooth and stubble free.

Reference is now made FIGS. 9 through 12, wherein a hot wax applicator having an improved dispensing head is depicted, like reference numerals being utilized to denote like elements described above. Reservoir 40 includes a threaded neck 87 having an opening 88 at the top 89 thereof through which the depilatory wax can flow when heated to a melt or flowable condition when the applicator is inserted into heating sleeve 50 in the manner described above.

Dispenser head 44 includes an interior cross-strut 45 that defines an opening **45*a*. Threaded cap-like wall 90 depends from strut 45 and permits dispensing head 44 to be secured to reservoir 40 so that the hollow interior of the dispensing head is in fluid communication through opening 45a and opening 88 in the strut and neck respectively to the reservoir 40**.

Figure 11:
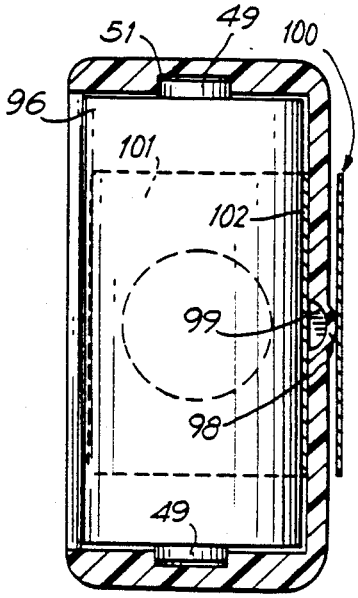
FIG. 11 is a sectional view taken along line 11—11 of FIG. 9.
Figure 12:
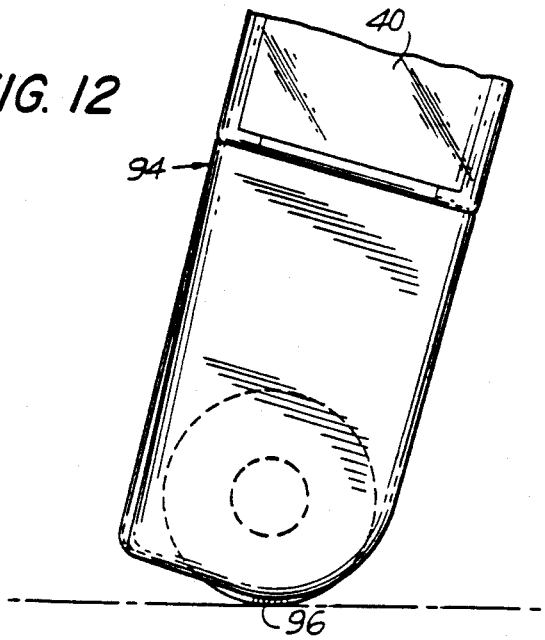
FIG. 12 is a side elevational view of the applicator illustrated in FIG. 9 when in use.

Dispenser head 44 is defined by a front metering wall 92, radiused opposed shoulders 93 and a rear return wall 94 which define an opening for receiving a roller having a continuously smooth surface 96 therein. As depicted in FIG. 11, the roller surface 96 includes projections 49 which are captured in blind holes 51 formed on opposed inner surfaces of shoulders 93. Front metering wall 92 is spaced from the radial dimension of roller 46 a predetermined distance to define a clearance of between 0.010 and 0.020 inches to act as a wiper to limit the thickness of the wax flowing onto the roller.

Rear return wall 94 is longer than front metering wall 92 and extends almost to the highest elevation (FIG. 10) of the roller 96 when the applicator is in an upright position. Return wall 94 is spaced apart from the surface of roller 96 by a distance that is greater than 0.020 inches thereby defining a larger gap between the surface of roller 96 and rear wall 94.

By providing a shorter front metering wall 92 and a longer rear wall 94, roller 96 applies wax in a single direction. Specifically, by increasing the gap between the surface of roller surface 96 and the rear wall to a distance that is larger than the gap between the front metering wall 92 and the roller surface 96, the wax that is not distributed by the roller during roll-out returns to the reservoir under the roller and is remetered on the next revolution of the roller. This avoids wax being scraped off by the metering edge of the back wall and running down the side of the roller head when both the front metering wall and rear metering wall define a metering clearance on the order of 0.010 to 0.020 inches.

As illustrated in FIGS. 9 and 11, an air vent groove 98 is provided in rear wall 94 and increases in size as it extends to to top of return wall 94 to define a semi-circular vent 99 at the top of rear wall 94. Vent 98 permits air to escape from the reservoir when roll-out of heated wax is complete and the reservoir is returned to an upright position. Also, when the applicator is stored after an initial use and the wax is again reheated, vent 98 permits the air to escape from the reservoir and the dispensing head as the wax is heated. Without the use of vent 98, air can become trapped inside the reservoir and can act upon the wax in the reservoir under the roller head and upon wax that remains in the gap between the front metering wall 92 and the roller surface 96 thus causing wax to drip onto the outside of the roller body and result in an unclean condition.

Figure 10:
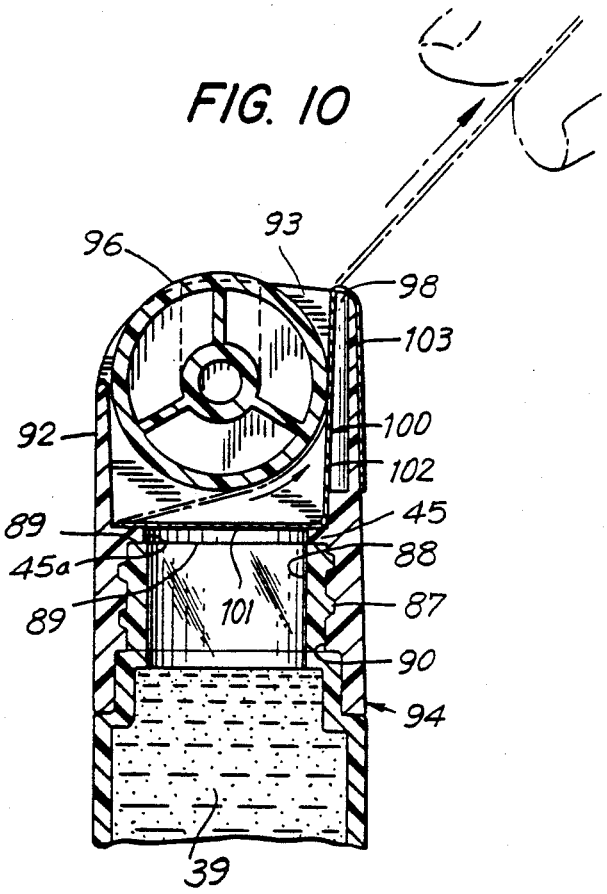
FIG. 10 is a sectional view taken along line 10—10 of FIG. 9.

Reference is also made to FIGS. 9 through 11, wherein a foil seal, generally indicated as 100, is depicted. Foil seal 100 includes a portion 101 that is fixed over the opening **45*a* in cross-strut 45 positioned under the roller. Foil seal 100 also includes a portion 102 which runs along rear wall 94 and terminates in flap 103. Flap 103 defines an exposed pull tab. Accordingly, by pulling the tab 103, in the manner illustrated in phantom in FIG. 10, foil seal 100 is removed from opening 45*a* thereby permitting fluid communication between the wax and reservoir 39 and the roller surface 96 in dispensing head 44**.

In an exemplary embodiment, seal 100 is formed of air impervious aluminum foil coated with a polyethylene lamination. The seal is bonded to the inner walls of the dispensing head by a heat "weld" of the polyethylene lamination to the inner surfaces of the dispensing head. A bonding of this type results in an air-tight, leak-proof yet easily releasable seal that can be readily peeled away from the orifice. A seal of this type prevents wax from flowing from the reservoir when the reservoir is exposed to ambient conditions that might render the wax flowable during storage and handling.

Also, it has been observed that in certain conditions, a grooved roller of the type illustrated in FIGS. 1 through 8 creates a wax meniscus at the ends of the grooves. Accordingly, continuously smooth roller surface 96 can result in a consistent film thickness that provides a neater and cleaner result with respect to certain applications. Although grooves have been found to be appropriate and preferred when a narrow area, such as the arch of an eyebrow or the curve of a lip is to be waxed, a smooth roller is preferred when the area is wider, such as when waxing a leg.

The hot wax hair remover apparatus of the present invention provides a hot wax depilatory system which can be safely used in the home without the need for professional assistance. The construction of the applicator device is such that a sufficiently thin layer of hot wax is applied to the skin which leaves the final skin temperature below the threshold temperature for thermally evoked pain although the wax is heated to a temperature of about 150° F. Moreover, the instant invention improves the efficiency and completeness of hair removal when compared to known techniques because a thin film at a high temperature will wet the hairs more completely and thereby provide increased adhesion of the hair to the wax. The heating mechanism automatically heats the wax in the reservoir which forms a part of the applicator. Thus, the spilling of wax is prevented as in the old vat techniques and the enclosed reservoir acts as the hand grip for the applicator.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A wax applicator for use with a heating sleeve for dispensing a depilatory wax for removal of hair from skin comprising a reservoir means for holding said depilatory wax, said reservoir means including a neck having an opening therein through which said depilatory wax can flow, said reservoir means defining a container configured to be disposed into a heating sleeve, said depilatory wax being normally disposed in a substantially solid state when at room temperature and being disposed into a flowable state by the force of gravity when the dispenser is disposed in a heating sleeve and is heated above a predetermined temperature of 112.2° F., a human's threshold temperature of thermally evoked pain, a dispenser head, said dispenser head including a roller seated within a plurality of surrounding housing walls forming a housing, so that a surface of said roller in facing relationship with a first housing wall which has a predetermined clearance therebetween for limiting the thickness of the flowable hot wax that is dispensed by gravity so that the thickness of the waxed dispensed thereby does not exceed 0.8mm, said housing further supporting a strut means, said strut means defining an opening so that said strut means is securable to said neck of said reservoir means to permit gravity to cause said wax to flow through said opening in said neck and said opening in said strut means into contact with said roller when said wax is heated so that a layer of heated wax not exceeding 0.8mm is dispensed by said roller wherein a second housing wall in facing relationship with said roller is spaced at a distance greater than 0.8mm to permit wax remaining on said roller to be carried by said roller and remetered on the next revolution of said roller.

2. A wax applicator, as claimed in claim 1, wherein said second housing wall extends beyond the position where it defines a clearance with the roller to assure that wax is dispensed by said roller in a single direction to assure that said wax is metered by said first housing wall.

3. A wax applicator, as claimed in claim 2, wherein said housing walls that connect said first housing wall and said second housing wall are radiused from said first housing wall to said other wall in such manner that the surface of said roller projects therefrom to provide a contact surface for said roller when heated wax is dispensed thereby.

4. A wax applicator, as claimed in claim 1, wherein said second housing wall includes vent means disposed therein for permitting air to escape from said reservoir means when said applicator is disposed in an upright position.

5. A wax applicator, as claimed in claim 1, and including a sealing strip, said sealing strip being releasably secured to said opening in said strut means to releasably seal said wax in said reservoir means and prevent said wax from escaping therefrom during storage and handling of said applicator.

6. A wax applicator, as claimed in claim 1, wherein said strut means includes a threaded cap wall depending therefrom, and the neck of said reservoir means being threaded, so that said cap wall in said dispenser head can be screwed onto said threaded neck of said reservoir means to permit said dispenser head to be releasably secured to said reservoir means.

* * * * *